US005109763A

United States Patent [19]

Morris et al.

[11] Patent Number: 5,109,763

[45] Date of Patent: May 5, 1992

[54] OIL FILTER CRUSHER UNIT

[75] Inventors: Glenn A. Morris; Leland M. Perkins, both of Thousand Oaks, Calif.

[73] Assignee: G. A. Morris Enterprises, Inc., Newbury Park, Calif.

[21] Appl. No.: 629,223

[22] Filed: Dec. 17, 1990

[51] Int. Cl.[5] ..... B30B 15/16; B30B 9/02; B30B 9/32

[52] U.S. Cl. ..... 100/48; 100/53; 100/98 R; 100/125; 100/131; 100/252; 100/266; 100/269 R; 100/902

[58] Field of Search ..... 100/48, 53, 98 R, 125, 100/131, 246, 252, 266, 268, 269 R, 295, 902

[56] References Cited

U.S. PATENT DOCUMENTS

| | | | |
|---|---|---|---|
| 769,015 | 8/1904 | Peirce . | |
| 2,316,734 | 4/1943 | Wells | 100/53 |
| 2,625,310 | 1/1953 | Davis | 100/53 X |
| 2,800,159 | 7/1957 | Walsh et al. | 100/266 X |
| 2,904,097 | 9/1959 | Cohen | 100/902 X |
| 2,916,985 | 12/1959 | Beach | 100/53 |
| 2,982,200 | 5/1961 | Robertson et al. | 100/53 |
| 3,055,289 | 9/1962 | Komph, Sr. | 100/53 |
| 3,185,071 | 5/1965 | Foss et al. | 100/53 |
| 3,580,166 | 5/1971 | Longo | 100/98 R X |
| 4,334,469 | 6/1982 | Tanner et al. | 100/98 R X |
| 4,492,156 | 1/1985 | Zimmer | 100/902 X |
| 4,570,536 | 2/1986 | Dodd | 100/53 |
| 4,771,686 | 9/1988 | Triantos, Jr. | 100/131 X |
| 4,860,646 | 8/1989 | Spiers | 100/48 |
| 4,927,085 | 5/1990 | Oberg | 100/131 X |
| 4,970,951 | 11/1990 | Katz | 100/98 R X |
| 5,060,564 | 10/1991 | Buford et al. | 100/902 X |

FOREIGN PATENT DOCUMENTS

| | | | |
|---|---|---|---|
| 857578 | 12/1960 | United Kingdom | 100/53 |

*Primary Examiner*—Harvey C. Hornsby
*Assistant Examiner*—Stephen F. Gerrity
*Attorney, Agent, or Firm*—Kelly, Bauersfeld & Lowry

[57] ABSTRACT

An improved oil filter crusher unit is provided for use in recovering used motor oil from an oil filter of the type used in automotive vehicles and for reducing the volumetric size of an oil filter prior to disposal with other trash in a landfill or the like. The crusher unit includes a crushing piston assembly having a pneumatic piston connected via a bearingless piston shaft to a filter crushing head. An air circuit system provides pressurized air to the piston assembly to advance the crushing head into engagement with an oil filter disposed within a crushing chamber. A control lever on the outside of the unit mechanically interlocks with a safety door to prevent access to the crushing chamber during unit operation. In addition, the geometry of the crushing head incorporates one or more protrusions which initiate filter crushing by crimping localized areas of the filter and thereby weaken the filter so that crushing can be accomplished with relatively low peak crush forces.

17 Claims, 4 Drawing Sheets

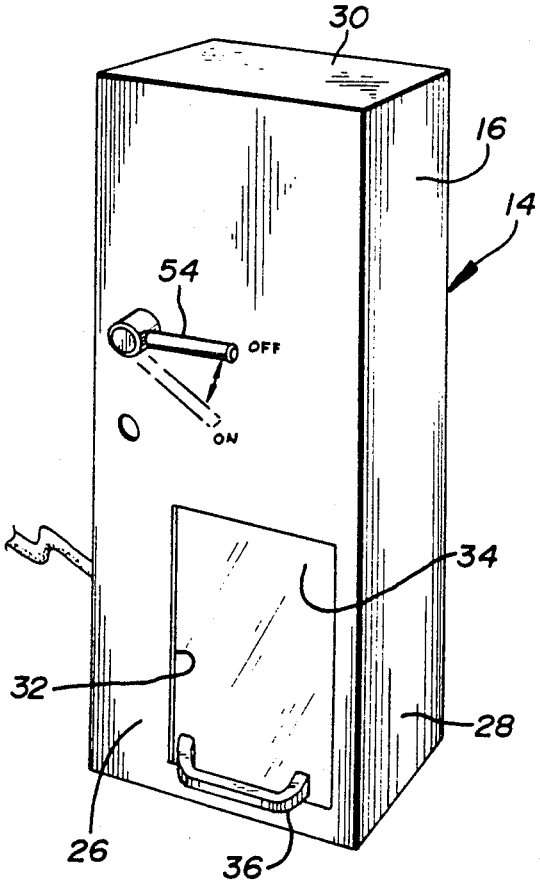
FIG. 1
FIG. 2
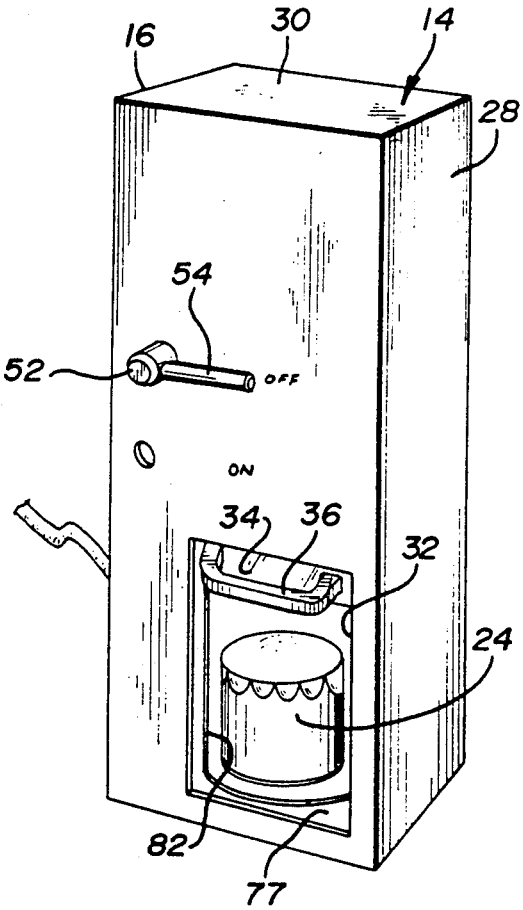
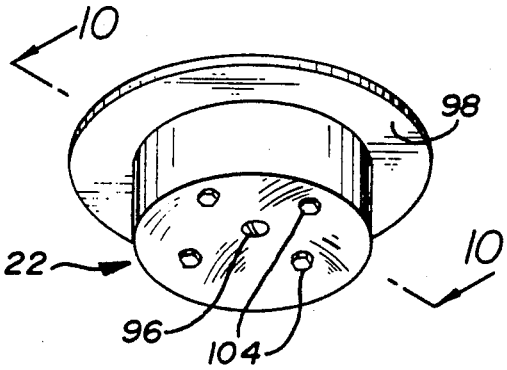
FIG. 9

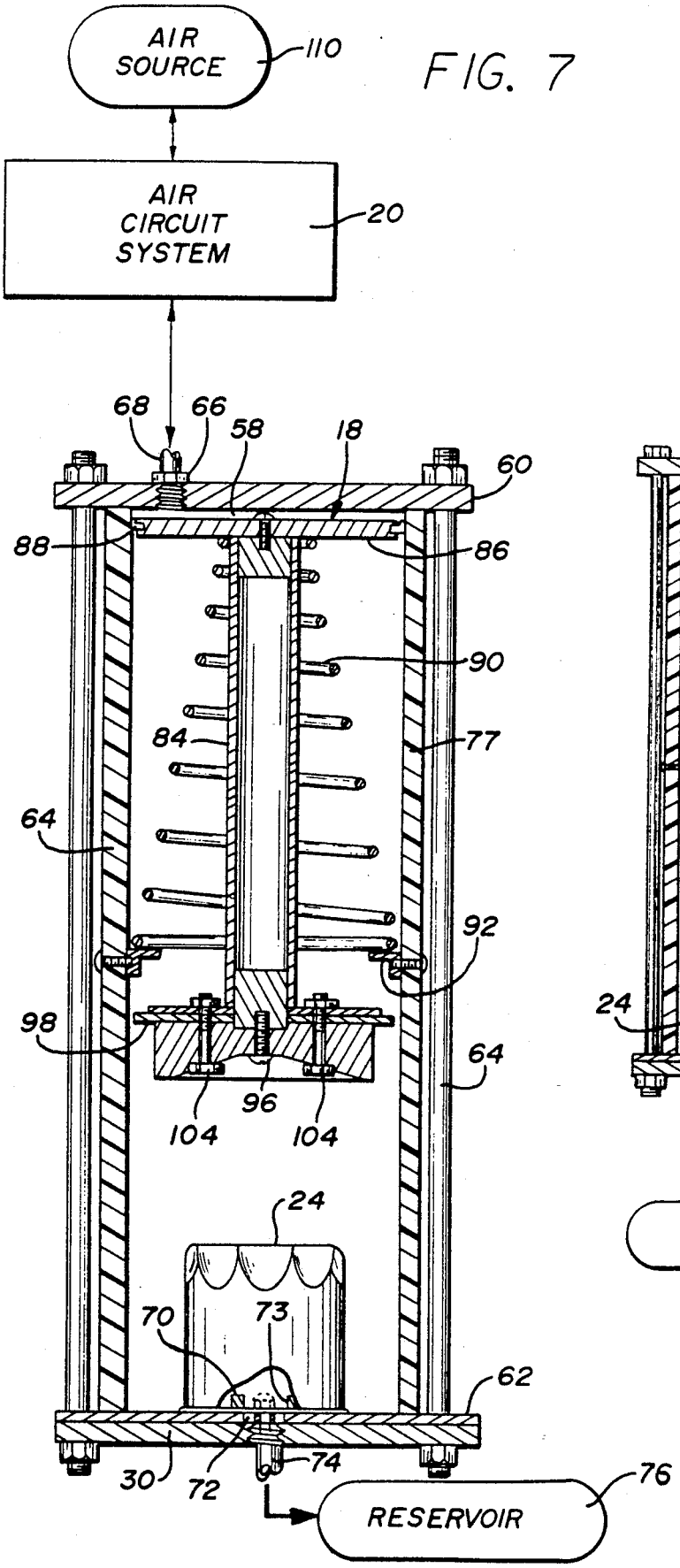
FIG. 7
FIG. 8
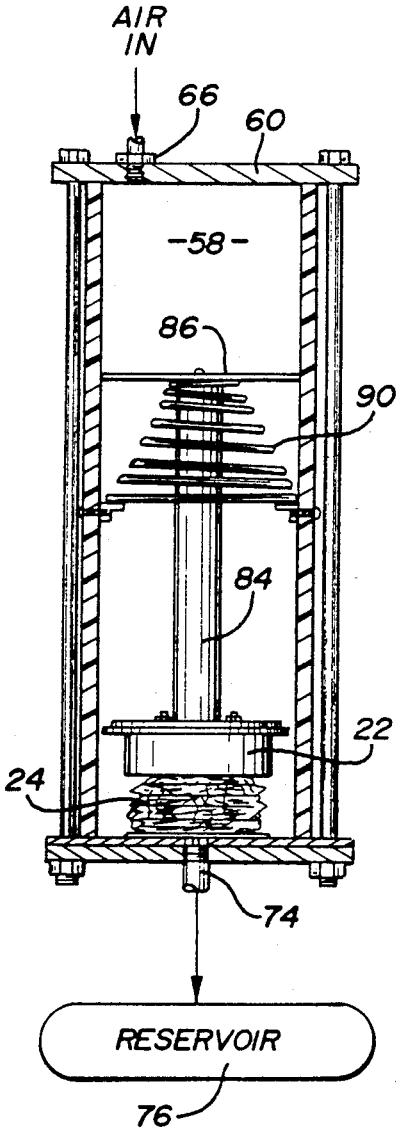

OIL FILTER CRUSHER UNIT

FIELD OF THE INVENTION

The present invention relates generally to an oil filter compactor device that effectively aids in reducing toxic waste and overall waste volume in landfills. More specifically, this invention relates to an oil filter crusher unit which significantly reduces the volume of a used oil filter and further permits the recovery of a substantial majority of the residual oil normally contained in the used oil filter.

BACKGROUND OF THE INVENTION

Used oil filters from automotive vehicles normally contain a significant quantity of residual oil and therefore may be characterized as toxic or hazardous waste items. Such oil filters cannot be discarded in ordinary waste containers for dumping with other non-toxic waste in a landfill. Instead, used oil filters must be hauled away from lube shops, auto dealers, and service stations, etc. by costly toxic waste disposal services which collect and handle toxic materials at considerable expense. Unfortunately, despite the significant publicity and increasing levels of governmental regulation characterizing used oil filters as a toxic waste material, the cost and inconvenience of special handling for disposal frequently results in dumping of oil filters with other non-toxic trash. Moreover, used oil filters are largely hollow in construction and thus, when discarded, constitute relatively voluminous items. Since trash disposal fees are often charged on a volumetric basis, disposal of a large number of used oil filters from an automotive service facility can be relatively costly.

In recent years, increasing attention has been directed toward removing residual oil from used oil filters so that the recovered oil can be recycled and further to permit the oil filter to be inexpensively discarded as a non-toxic waste product. Such recovery of the used oil has traditionally been accomplished by orienting the filter over a collection pan or basin and then allowing the oil to drain. However, tests have shown that a significant amount of oil will remain in the filter even after a prolonged drain period of several days. Moreover, in an automotive service facility wherein a large number of oil filters are to be discarded, draining oil filters can occupy an objectionable amount of space.

Accordingly, there exists a need for a compact device for quickly and easily recovering a substantial majority of the residual oil within a used oil filter to permit oil recycling and to convert used oil filters to a conventional non-toxic trash item for inexpensive disposal. Moreover, there is a further need for a device to reduce the volume of a used oil filter, thereby reducing the trash volume generated from automotive service facilities and the like. Additionally, there is a need for such a device which is compact and light in weight, quiet and fast in operation and easy to operate within a normal automotive service shop environment. The present invention fulfills these needs and provides other related advantages.

SUMMARY OF THE INVENTION

According to the present invention and the exemplary embodiments described herein, an oil filter crusher unit is provided for use in crushing a used oil filter to recover residual oil in the filter to prevent the oil from entering waste management landfills, to reduce the volumetric size of the used oil filter to take up less space in the landfill, and/or to recycle the oil filter as scrap metal. The oil filter crusher unit generally comprises a compact housing adapted to be used on the floor or mounted to a wall of an automotive service facility or the like, and including air circuit control means within the housing for regulating a supply of compressed air to a crushing piston assembly to crush the oil filter.

In a preferred embodiment, the oil filter crusher housing has an upright rectangular box shape with a front plate having a lower access opening formed therein. The access opening is selectively closed from the inside of the housing by a safety access door adapted to slide up and down. A handle is positioned on the outside of the door. A spring-loaded locking cam mounted within the housing is moved by a control lever on the outside of the housing to prevent operation of the crusher unit when the safety access door is open, and to prevent opening of the access door during operation of the crusher unit.

The control lever also operates the air circuit control means when the lever is moved to an "on" position. In this position, the air circuit control means provides compressed air to the crusher unit for a length of time as determined by a time control circuit. The time control circuit automatically returns the control lever to an "off" position at the completion of a crushing cycle, desirably about 10 seconds.

The crusher unit housing defines a hollow and generally cylindrical crushing chamber constructed from heavy wall plastic tubing or the like. The access opening also opens into a lower portion of the crushing chamber to permit the oil filter to be placed into the lower portion of the crushing chamber for crushing, and further to permit filter removal once crushing is completed or until the next oil filter is to be crushed. The oil filter is positioned for crushing with its central mounting nut seated over a short stud on a base plate at the bottom of the crushing chamber. A drain is formed in the base plate adjacent to the stud and leads to a reservoir typically disposed outside the housing.

The compressed air from the air circuit control means forces a piston of the piston assembly in an upper portion of the housing to descend and to remain in a descended position for the duration of the crushing cycle to crush an oil filter placed into the crushing chamber. The piston is connected to a piston shaft which is attached in turn to a floating crushing head. A return spring is carried about the piston shaft and is collapsed upon descending motion of the piston. At the end of a crush cycle, the spring returns the piston assembly to its original position.

The crushing head has a contoured face designed for localized crimping of one or more small areas in the top of the oil filter upon initial contact therewith. This initial crimping of localized areas overcomes the structural resistance of the filter to crushing forces, and thereby allows filter crushing to proceed with lower overall peak crushing pressures. In a first illustrated embodiment, the crushing head face is concave with four protruding bolt heads at different radial positions. The bolt heads are positioned to contact an oil filter near a top rim of the filter. In the second illustrated embodiment, grooves are milled across the face of the crushing head.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 1 is a perspective view of an oil filter crusher unit embodying the novel features of the invention, and illustrating the unit with a safety access door in a closed position;

FIG. 2 is a perspective view illustrating the crusher unit with the control lever in an "off" position thereby permitting raising of the safety access door to provide access to an oil filter placed into the unit;

FIG. 7 is a somewhat schematic elevational view showing a crushing piston assembly;

FIG. 8 is a somewhat schematic view similar to FIG. 7 showing operation of the piston assembly to crush an oil filter;

FIG. 9 is a bottom perspective view of a preferred geometry for a crushing head;

DETAILED DESCRIPTION OF THE PREFERRED EMBODIMENT

Figure 3:
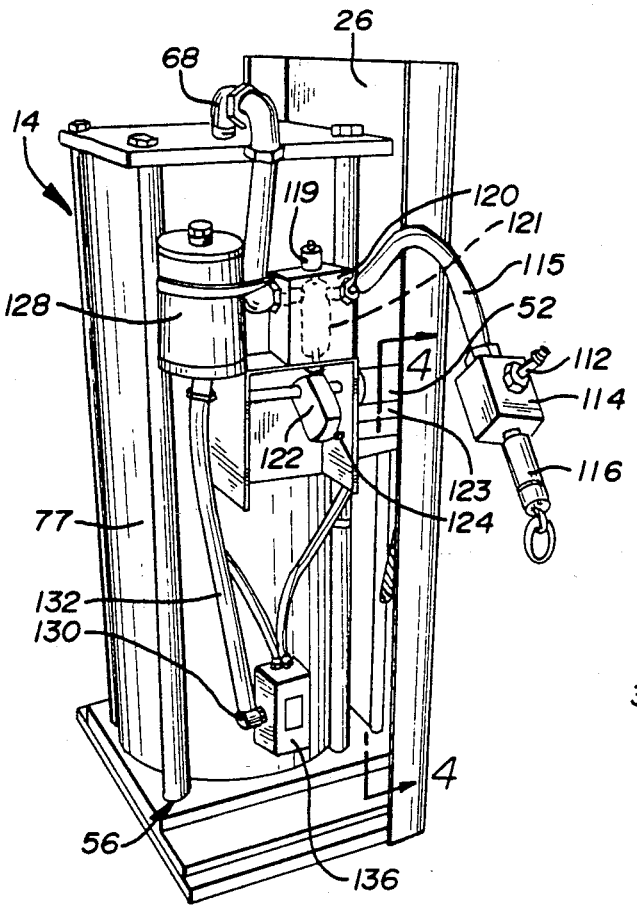
FIG. 3 is a side perspective view of the crusher unit with a portion of an external housing removed to illustrate internal components.

As shown in the drawings for purposes of illustration, an improved oil filter crusher unit referred to generally in FIG. 1 by the reference number 14 is provided for compacting a used oil filter, thereby permitting recovery of a substantial majority of residual oil contained in the oil filter and compacting the oil filter to a reduced size taking up less space in a waste management landfill. The crusher unit 14 is specifically designed to be compact and light in weight, quiet and fast in operation and safe and easy to operate within a normal automotive repair facility environment.

In accordance with the present invention, and as illustrated with respect to a preferred embodiment in FIGS. 1–10, the oil filter crusher unit 14 generally comprises a housing 16 enclosing a crushing piston assembly 18 (FIG. 7) and an air circuit control system 20. The air circuit control system 20 regulates the supply of compressed air to displace a crushing head 22 contained in the housing 16 in a downward direction to crush an oil filter 24.

The oil filter crusher housing 16 has an upright rectangular box shape which includes a generally planar front plate or panel 26. The front plate 26 is connected to a pair of upstanding side walls 28 and to a pair of top and bottom end walls 30. In a preferred form, the housing 16 is made from a heavy gauge metal such as aluminum or steel sheet, and desirably has a powder coat paint finish for chemical resistance.

As illustrated in FIGS. 1 and 2, a lower portion of the housing front plate 26 defines a generally extending rectangular opening 32. The opening is selectively closed from the inside of the housing by a safety access door 34 adapted to slide up and down to expose and cover the opening, respectively. A horizontally positioned handle 36 is mounted on the outside and bottom edge of the door 34 for easy manual grasping to open and close the door, as desired.

Figure 5:
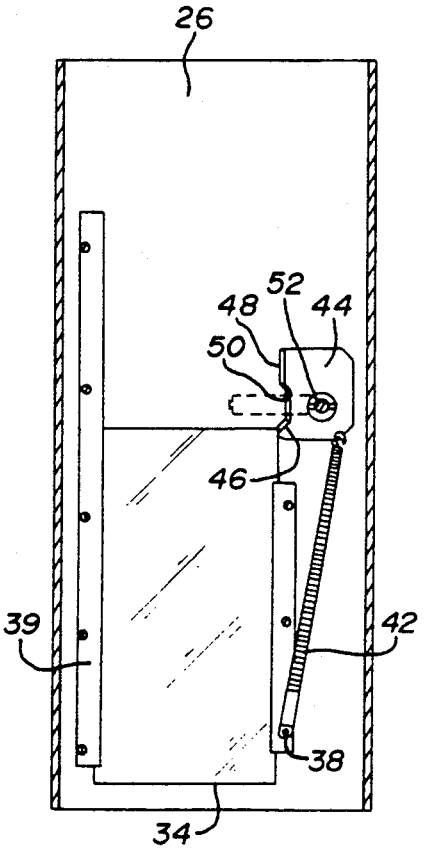
FIG. 5 is a vertical sectional view similar to FIG. 4 and illustrating the access door in a closed but unlocked position.
Figure 4:
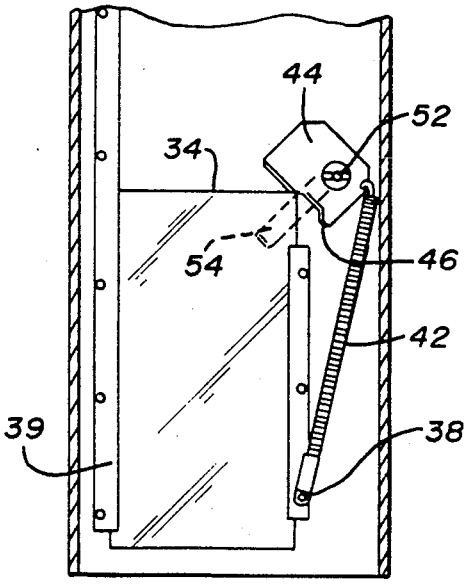
FIG. 4 is a fragmented vertical sectional view illustrating the safety access door in a closed and locked position.
Figure 6:
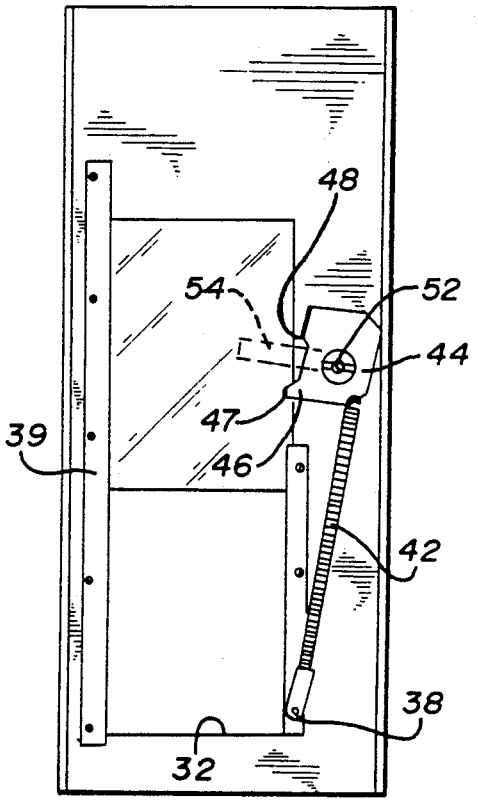
FIG. 6 is a vertical sectional view similar to FIGS. 4 and 5 illustrating the safety access door in an open position.
Figure 10:
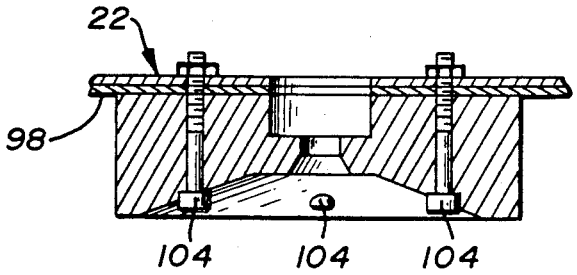
FIG. 10 is a vertical sectional view of the crushing head taken generally along the line 10—10 of FIG. 9.

As illustrated in FIGS. 4–6, vertical guide rails 38 and 39 are mounted along opposite sides of the door opening 32 on the inside of the housing 16 and in parallel relation to each other. These guide rails 38 and 39 define tracks for receiving the opposite side edges of the door 34, thereby enabling the door 34 to slide up and down. The guide rails as shown are unequal in vertical length, with the shorter guide rail 38 terminating at a point near the upper margin of the door opening 32. A spring 42 is attached to a lower end of the rail 38. This spring 42 in turn is connected at an upper end to a door locking cam 44 positioned generally adjacent to an upper corner of the door opening 32. The rail 39 is taller than the rail 38 and extends vertically for a substantial distance above the opening 32.

The door locking cam 44 has a lower lip 46 and an upper lip 48, with a recessed cam surface 50 therebetween. The door locking cam is connected by a pin 52 extending through the front plate 26 to a control lever 54 on the outside of the housing. The position of the door locking cam 44 changes as a result of swinging movement of the control lever 54. The control lever 54 operates the door locking cam 44 to prevent operation of the crusher unit 14 when the safety access door 34 is open, and to prevent opening the door 34 during operation of the crusher unit 14.

More specifically, as illustrated in FIGS. 1 and 4, the upper lip 48 of the door locking cam 44 blocks upward sliding motion of the safety access door 34 when the control lever 54 is in the "on" position (shown in phantom in FIG. 1). As shown best in FIG. 5, rotation of the lever 54 to an "off" position orients the cam lips 46 and 48 to permit sliding door motion between open and closed positions. However, when the door 34 is opened, the lower cam lip 46 seats into a notch 47 (FIG. 6) in the door to releasably hold the door open. In this position, the raised (open) door 34 blocks the control lever 54 to prevent return motion to an "on" position unless and until the door is closed.

A crushing frame 56 is mounted within the housing 16, as shown in FIGS. 3, 7 and 8. The crushing frame 56 includes top and bottom end plates 60 and 62 interconnected by a plurality of upstanding tie rods 64. The top end plate 60 includes an inlet port 66 connected to an air supply conduit 68 from the air circuit control system 20. During operation of the unit 14, the inlet port 66 passes compressed air into an upper air cylinder chamber 58. The bottom end plate 62 is immediately above the bottom end wall 30 of the housing 16. In the center of the bottom end plate 62, a short stud 70 is provided for extending into the central mounting nut 73 of the oil filter 24 to be crushed. A drain port 72 is formed close to and/or around the stud 70. When the oil filter is crushed, residual oil therefrom drains downwardly from the filter through the drain port 72, and further through a drain tube 74 to a reservoir 76, typically disposed at a convenient location outside the housing 16.

The air cylinder crushing chamber 58 is defined within an upper region of an upstanding cylinder 77 made from rigid tubing, for example, metal such as aluminum or thin-walled steel or PVC (polyvinylchloride), with a length to extend between the top and bottom end plates 60 and 62. An access opening 82 is formed at one side of a lower portion of the cylinder 77 in alignment with the safety access door 34 and the door opening 32 associated therewith. This arrangement permits the used oil filter 24 to be inserted into the lower portion of the cylinder 77 for crushing when the door 34 is opened In addition, after crushing is completed, the crushed filter can be removed from the cylinder 77.

It will be understood, of course, that the cylinder 77 may be in more than one section. For example, the upper air cylinder chamber may be separate from the lower crushing unit chamber and they may be made of different materials (e.g. one metal, one PVC)

The piston assembly 18 is mounted within an upper region of the cylinder 77 and includes a piston shaft 84 attached at a first end to a piston 86 loosely fitted in the crushing chamber 58. The piston 86 and the crushing chamber dimensions allow for a relatively loose sliding fit to accommodate plastic tubing or other structural components which need not be formed with precision tolerances. A U-shaped seal 88 at the periphery of the piston 86 slideably engages the inside surface of the cylinder 77. A return spring 90 is carried about the piston shaft 84 and reacts between the piston 86 and an annular support rib 92 within the cylinder 77 to urge the piston 86 in an upward direction. The return spring 90 is tapered for nested collapse upon descending motion of the piston 86.

A second or lower end of the piston shaft 84 fits into the back of the crushing head 22. A bolt 96 may be based to fix the piston shaft 84 to the crushing head 22. A stabilizing disk 98 may be mounted immediately above the crushing head to insure floating yet generally aligned movement of the crushing head 22 within the cylinder 77. In the illustrative embodiment, the disk 98 permits a small amount of lateral deviation yet maintains the head 22 generally centered within the cylinder 77.

The crushing forces required to initiate collapse of the oil filter 24 are typically from about 30% to over 100% in excess of the force required to complete the crushing cycle. That is, once filter deformation starts, the force required to continue the crushing action reduces significantly. In this regard, it is desirable for initial filter deformation in the form of localized crimping of one or more small areas in the top of the oil filter 24. As soon as this initial deformation or prebending occurs, reduced crushing forces may be used. The crushing head 22 has a contoured face designed to aid in this endeavor.

Figure 11:
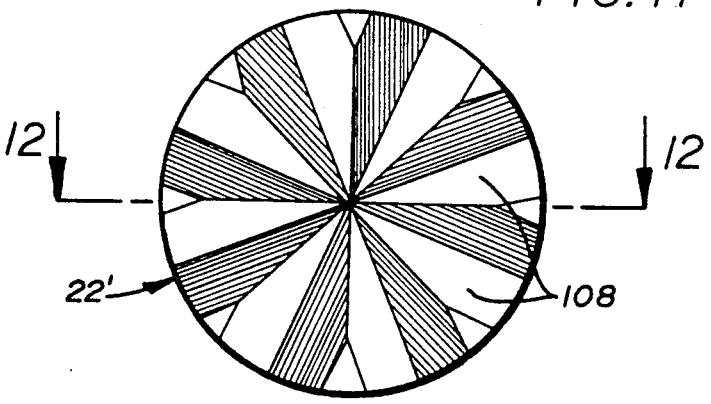
FIG. 11 is a bottom plan view illustrating an alternative crushing head geometry having grooves formed in the face of the crushing head.
Figure 12:
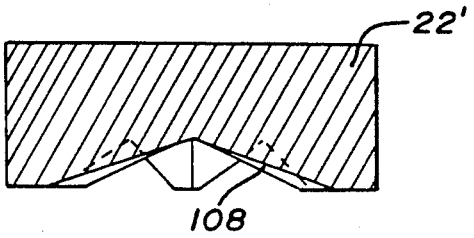
FIG. 12 is a vertical sectional view taken generally on the line 12—12 of FIG. 11.

In a preferred embodiment as illustrated in FIGS. 7–10, the face of the crushing head 22 is concave with a diametric size slightly greater than the diameter of the filter 24 to be crushed. A plurality of bolt heads 104 interrupt the concave head geometry, preferably at different radii selected to engage the outer edges of oil filters of different standard sizes. In a second illustrated embodiment shown in FIGS. 11 and 12, grooves 108 are milled across the face of a modified crushing head 22'. In either geometry, the contoured crushing head face provides for localized pre-bending of the oil filter to initiate collapse which can then proceed at a relatively low peak force. It will be understood, of course, that a variety of different crushing head diametric sizes and contoured shapes can be used.

The air circuit control system 20 is adapted for normal connection to a source 110 of compressed air (FIG. 7) of the type generally available in most automotive service shops. The use of compressed shop air eliminates the need for electric motors and controls which could otherwise pose an electrical hazard. An air source of at least 80 psi is available in most automotive service shops and the device is compatible with this air pressure.

As illustrated in FIG. 3, the compressed air enters the air circuit system through an air inlet 112 of a three-port coupler 114 positioned outside the housing 16. The three-port coupler 114 connects the air inlet 112 with an air supply hose 115 and with a pressure limiting safety relief valve 116. The air supply hose 115 extends further to the air circuit system 20 enclosed within the housing 16 through an appropriate aperture (not shown) in one of the housing side walls 28. The relief valve is preferably a National Board Certified ASME standard safety valve made from brass and stainless steel. The relief valve is factory set below the pressure ratings of the components inside the housing to protect the air circuit system from possible excess air pressure.

Inside the housing, the air supply hose 115 is connected to a three-port control valve 120 which, when the device is turned "on", regulates the flow of the fluid (air) to the piston assembly 18. The three-port valve 120 is adapted to connect the air chamber 58 (FIG. 7) to the compressed air supply 110 via the air supply conduit 68, or to exhaust the chamber 58 via an exhaust vent 119.

By turning the control lever 54 to the "on" position, the pivot pin 52 within the housing 16 rotates a valve control cam 122 to lift a valve spool 121 within the three-port valve which opens the three-port valve 120. The valve control cam 122 is maintained in the "open" position by a spring-loaded latch pin 124 operated by a small one-way air cylinder 123. Opening the valve 120 allows air to pass through the valve to the small air cylinder 123 and to the air chamber 58 by means of the conduit 68. The pressurized air fills the chamber 58 and forces the piston 86 in a downward direction. As a result, the crushing head 22 descends to crush the oil filter 24.

Opening the three-port valve 120 also allows air to pass through to a time control circuit 126 which automatically closes the valve 120 after a predetermined length of time ("crushing cycle"). More specifically, the time control circuit 126 includes a time delay module 136 which first receives the air from the three-port valve 120 and an air accumulator 128 which receives air from the time delay module 136 through a small restrictive orifice 130 and associated hose 132. When the air pressure in the accumulator 128 builds to a level slightly under the source air pressure, a shuttle valve (not shown) in the time delay module is shifted so that air from the time delay module no longer goes to the air accumulator but instead flows to the latch pin 124. The air is exhausted from the air cylinder 123 which spring retracts the latch pin 124 which releases down the valve control cam 122 and the valve spool 121 and returns the three-port valve 120 to the "off" position thereby recoupling the chamber 58 to the exhaust vent 119. The control lever 54 automatically returns with the released cam 122 to the "off" position.

In using the oil filter crusher unit, the operator first raises the safety access door 34 and inserts a used filter 24 to be crushed. The door 34 is then closed and the control lever 54 is rotated to the "on" position. With the control lever in the "on" position, the crushing head 22 descends within the cylinder 77 to crush the oil filter placed therein. The time control circuit 126 allows the downstroke of the crushing head to dwell at full power for a time sufficient to achieve maximum crushing effects, with a desired crush cycle time being approximately 10 seconds. After the cycle time expires, the time control circuit disconnects the air supply from the piston assembly and exhausts the chamber 58 via the vent 119. The internal spring 90 then returns the piston 86 to its original position. While the crushing is taking place, the operator is free to perform other tasks and need not unload the crushed filter from the device until another filter is ready for crushing.

From the foregoing, it is to be appreciated that the oil filter crushing unit 14 of the present invention is compact and effective in recovering the residual oil from a used oil filter. The crushing unit thus converts the oil filter to a non-toxic waste product of substantially minimum volume.

Although a particular embodiment of the invention has been described in detail for purposes of illustration, various modifications may be made without departing from the spirit and scope of the invention. Accordingly, the invention is not to be limited, except as by the appended claims.

What is claimed is:

1. An oil filter crusher unit, comprising:

a housing having an internal chamber formed therein, said housing defining an access opening at a lower end thereof to permit a used oil filter to be placed into said internal chamber, said housing further including a lower end plate at a lower end of said internal chamber, said lower end plate having a drain port formed therein and having a short stud projecting upwardly therefrom at a position generally adjacent to said drain port, the stud extending into a central mounting member of the oil filter to position the filter for crushing;

a door movably mounted on said housing for movement between open and closed positions respectively permitting and preventing access to said internal chamber through said access opening;

a piston assembly within an upper end of said housing, said piston assembly including a piston and a crushing head mounted for movement with said piston; and control means for providing a fluid under pressure to said piston assembly to displace said piston in a direction moving said crushing head to crush an oil filter within said internal chamber, said control means further including means for preventing supply of the fluid under pressure to said piston assembly when said door is in the open position, and for preventing said door from being moved to the open position while the fluid under pressure is supplied to said piston assembly.

2. The oil filter crusher unit of claim 1 wherein said crushing head has a contoured face adapted to contact an oil filter for initially crimping localized areas of the oil filter.

3. The oil filter crusher unit of claim 2 wherein said face of said crushing head includes at least one protrusion.

4. The oil filter crusher unit of claim 3 wherein said protrusion is a bolt head.

5. The oil filter crusher unit of claim 3 wherein said at least one protrusion comprises a plurality of bolt heads.

6. The oil filter crusher unit of claim 3 wherein said at least one protrusion comprises a plurality of protrusions at different radial positions.

7. The oil filter crusher unit of claim 2 wherein said face of said crushing head has a plurality of grooves formed therein.

8. The oil filter crusher unit of claim 1 wherein said housing includes at least one upright cylindrical member defining said internal chamber.

9. The oil filter crusher unit of claim 8 wherein said piston assembly further includes a piston shaft having upper and lower ends, said piston and said crushing head being mounted respectively at said upper and lower ends of said piston shaft, and spring means for normally urging said piston to move in a direction toward the upper end of said cylindrical member.

10. The oil filter crusher unit of claim 9 wherein said piston and said .crushing head cooperatively guide movement of said piston within said cylindrical member.

11. An oil filter crusher unit comprising:

an upstanding housing defining an internal chamber having an access opening formed therein to permit an oil filter to be placed into said chamber;

a safety access door;

means for mounting the safety access door to permit up and down sliding movement relative to said housing to open and close said opening, said mounting means including vertical guide rails mounted at both sides of the opening in parallel relation to each other;

a spring-loaded locking cam;

a control lever on the outside of the housing and operatively connected to said spring-loaded locking cam to prevent operation of the crusher unit when the safety access door is open and to prevent opening of the safety access door during operation of the crusher unit;

a piston assembly contained in the internal chamber, said piston assembly including a piston and a crushing head;

control means for providing compressed air to a portion of the chamber to displace the piston assembly in a direction to move the crushing head to crush the oil filter, said control means including a timer for controlling the length of time compressed air is provided to the chamber;

a drain at a lower end of said housing; and a reservoir for collecting oil flowing through said drain.

12. The oil filter crusher unit of claim 11 wherein said crushing head has a contoured face adapted to contact an oil filter for initially crimping localized areas of the oil filter.

13. The oil filter crusher unit of claim 11 wherein said lower end of said housing includes a lower end plate, said lower end plate having a short stud projecting upwardly therefrom at a position generally adjacent to said drain, said stud extending into a central mounting member of the oil filter to position the filter for crushing.

14. The oil filter crusher unit of claim 11 wherein said piston assembly further includes a piston shaft having upper and lower ends, said piston and said crushing head being mounted respectively at said upper and lower ends of said piston shaft, and spring means for normally urging said piston to move in a direction toward the upper end of said internal chamber.

15. The oil filter crusher unit of claim 14 wherein said piston and said crushing head cooperatively guide movement of said piston within said internal chamber.

16. An oil filter crusher unit, comprising:

a housing having an internal chamber formed therein, said housing defining an access opening at a lower end thereof to permit a used oil filter to be placed into said internal chamber, said housing further including a lower end plate at a lower end of said internal chamber, said lower end plate having a drain port formed therein;

a door movably mounted on said housing for movement between open and closed positions respectively permitting and preventing access to said internal chamber through said access opening;

a piston assembly within an upper end of said housing, said piston assembly including a piston and a crushing head mounted for movement with said piston;

control means for providing a fluid under pressure to said piston assembly to displace said piston in a direction moving said crushing head to crush an oil filter within said internal chamber, said control means including a movable control lever for selectively controlling supply of the pressurized fluid to said piston assembly and further including cam means coacting between said door and said lever for preventing supply of the fluid under pressure to said piston assembly when said door is in the open position, and for preventing said door from being moved to the open position while the fluid under pressure is supplied to said piston assembly; and track means for guiding said door between said open and closed positions.

17. An oil filter crusher unit, comprising:

a housing having an internal chamber formed therein, said housing defining an access opening at a lower end thereof to permit a used oil filter to be placed into said internal chamber, said housing further including a lower end plate at a lower end of said internal chamber, said lower end plate having a drain port formed therein:

a door movably mounted on said housing for movement between open and closed positions respectively permitting and preventing access to said internal chamber through said access opening;

a piston assembly within an upper end of said housing, said piston assembly including a piston and a crushing head mounted for movement with said piston;

control means for providing a fluid under pressure to said piston assembly to displace said piston in a direction moving said crushing head to crush an oil filter within said internal chamber, said control means further including means for preventing supply of the fluid under pressure to said piston assembly when said door is in the open position, and for preventing said door from being moved to the open position while the fluid under pressure is supplied to said piston assembly; and means for positioning and retaining the oil filter on said lower end plate during movement of said crushing head to crush the filter.

* * * * *